US010344473B2

(12) United States Patent
Lai et al.

(10) Patent No.: US 10,344,473 B2
(45) Date of Patent: Jul. 9, 2019

(54) DEVICE WITHOUT BLOCKING WIRELESS SIGNALS BASED ON IMPEDANCE MATCHING

(71) Applicant: SOOCHOW UNIVERSITY, Suzhou (CN)

(72) Inventors: Yun Lai, Suzhou (CN); Zhongqi Yao, Suzhou (CN); Jie Luo, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 0 days.

(21) Appl. No.: 15/580,068

(22) PCT Filed: Nov. 19, 2015

(86) PCT No.: PCT/CN2015/094993
§ 371 (c)(1),
(2) Date: Dec. 6, 2017

(87) PCT Pub. No.: WO2017/075847
PCT Pub. Date: May 11, 2017

(65) Prior Publication Data

US 2018/0298607 A1 Oct. 18, 2018

(30) Foreign Application Priority Data

Nov. 4, 2015 (CN) ..... 2015 1 0740921

(51) Int. Cl.
*E04B 2/02* (2006.01)
*E04C 2/26* (2006.01)
*H01Q 15/08* (2006.01)

(52) U.S. Cl.
CPC ..... *E04B 2/02* (2013.01); *E04C 2/26* (2013.01); *H01Q 15/08* (2013.01);
(Continued)

(58) Field of Classification Search
CPC .... E04B 2103/02; E04B 2103/04; E04C 2/26; E04C 2/28; E04C 2/288; E04C 2/044
See application file for complete search history.

(56) References Cited

U.S. PATENT DOCUMENTS 3,955,019 A * 5/1976 Keith ..... B26F 1/24 428/34.5
6,942,915 B1 * 9/2005 Kondo ..... B29C 66/1142 428/131

(Continued)

FOREIGN PATENT DOCUMENTS

CN 101072145 A 11/2007
CN 201243307 Y 5/2009

*Primary Examiner* — Christine T Cajilig
(74) *Attorney, Agent, or Firm* — SZDC Law P.C.

(57) ABSTRACT

The present invention provides a device without blocking wireless signals based on impedance matching. The device is constructed by periodically stacking two building materials with different dielectric constants in the same direction. The device without blocking wireless signals based on impedance matching can be designed as a wall body, and can improve wave transmission of microwaves to ensure that wireless signals won't be blocked at any incident angle, thereby achieving the unblocked transmission of wireless signals. Furthermore, compared with metal hole arrays, the component materials of the devices can include polypropylene and concrete, that expands the applications from micro circuit electronic devices to macro walls, and greatly reduces the manufacturing and maintenance cost.

2 Claims, 3 Drawing Sheets

(52) U.S. Cl.
CPC ... *E04B 2002/0278* (2013.01); *E04B 2103/02* (2013.01); *E04B 2103/04* (2013.01)

(56) References Cited

U.S. PATENT DOCUMENTS

| | | | | |
|---|---|---|---|---|
| 2004/0161595 | A1* | 8/2004 | Baines | B32B 5/32 428/304.4 |
| 2006/0032166 | A1* | 2/2006 | Devalapura | B32B 3/10 52/309.15 |
| 2008/0041004 | A1* | 2/2008 | Gibbar | E04C 2/288 52/309.12 |
| 2013/0074433 | A1* | 3/2013 | Ciuperca | E04B 1/355 52/426 |
| 2015/0184383 | A1* | 7/2015 | Foderberg | E04C 2/049 52/405.1 |
| 2016/0010330 | A1* | 1/2016 | Naito | E04C 2/46 52/405.2 |

* cited by examiner

DEVICE WITHOUT BLOCKING WIRELESS SIGNALS BASED ON IMPEDANCE MATCHING

This application is a PCT National Stage application of PCT/CN2015/094993, filed on Nov. 19, 2015, which claims priority to Chinese Patent Application No. 201510740921.6, filed on Nov. 4, 2015, which is incorporated by reference for all purposes as if fully set forth herein.

FIELD OF THE INVENTION

The present invention relates to a wall for passing of wireless signals, more particularly to a device without blocking wireless signals based on impedance matching.

DESCRIPTION OF THE RELATED ART

In recent years, the study on wave permeability enhancement of microwaves focuses mainly on periodic metallic structures. It is found that when electromagnetic waves are incident onto a sub-wavelength metallic hole/slit structure and a periodic fold structure, the electromagnetic waves can extraordinarily pass through such metals, leading to the wave transmission enhancement at certain frequencies. Currently, in addition to sub-wavelength hole arrays, the phenomenon of wave transmission enhancement also has been found in the study on sub-wavelength single holes such as slits, circular holes and annular holes. These enhancement effects are mainly caused by a local surface plasma mode excited at boundaries of small holes, thereby enhancing the wave transmission at the sub-wavelength single holes. However, these devices are mainly made of noble metal materials, the fabricating cost and maintenance cost are thus relatively high. In addition, most of the materials are only applicable for the micro microwave devices, such as a microstrip antenna, a microwave integrated circuit, etc., and cannot be applied for macro devices.

As we know, the wireless signals, like Wi-Fi signals or the mobile phone 4G signals, are generally blocked by a brick concrete wall in the transmission process, as the result of the impedance mismatch between the wall and free space. The existing methods to enhance the transmission of the wireless signals are mainly based on the enhancement of the source power or by using additional devices. For example, for better penetration of Wi-Fi signals through the wall, the Wi-Fi signal power is required to be enhanced by setting Wi-Fi parameters as 802.11N, selecting an MIMO enhancement mode, and adding a Homeplug and a wireless AP (Access Point) in the process of signal transmission, etc. But these methods would lead to significant cost growth in the equipment investment.

The disadvantages of the existing methods:

1. By enhancing the Wi-Fi single power. Since the impedance of the walls consisting of concrete and bricks is strongly mismatched to the impedance of free space, the Wi-Fi singles are blocked. Through enhancing the Wi-Fi signal power is hard to obtain strong Wi-Fi signal on the other side of walls. Furthermore, the existing Wi-Fi single frequencies include 2.4 GHz and 5 GHz. The wavelength of the electromagnetic waves corresponding to these frequencies are short, which makes it more difficult for the waves to penetrate or go around the walls.

2. By using sub-wavelength metallic hole arrays. In this case, the shape, size, number, period, depth of holes, as well as the dielectric constant of the medium in holes have dramatic influences on the wave transmission. Such methods are mainly based on the plasmas on the surface of the metals, that generate resonances to enhance the wave transmission. But, these methods are generally applied for the microelectronic devices, and are of high cost.

3. By adding additional equipment during propagation, such as Homeplug, wireless AP, etc. But, for ordinary families, they may not invest much for this. And for large companies, not only the number of equipment increases, but also line laying must be rearranged, and thus more manpower and resources are needed.

SUMMARY OF THE INVENTION

In order to solve the above technical problems, one goal of the present invention is to propose a composite material that allows broadband, wide-angle and polarization-independent high transmission of wireless singles. The high transmission through such a composite material is based on the impedance matching effect, which is designed to be easy to manufacture, robust to the tolerance of environment, and relatively low cost in fabrication and maintenance. The composite material not only can be used for a wall for partitioning residences, but also can be used for a visible transparent Wi-Fi wall to realize signal coverage without inputting extra funds to add relay equipment, thereby reducing the construction cost.

For the above purposes, the invention provides a device without blocking wireless signals based on the impedance matching effect. Such a device is constructed by periodically stacking two building materials with different dielectric constants in the same direction.

Preferably, the two building materials are polypropylene and concrete respectively.

Preferably, the two building materials are periodically stacked in an alternate mode.

By means of the above technical solution, as compared with the prior art, the present invention has the following advantages:

The device without blocking wireless signals based on the impedance matching effect of the present invention can be designed as a wall body, and can improve the wave transmission of microwaves to ensure that the wireless signals won't be blocked at any angle, thereby achieving unblocked transmission of wireless signals. Furthermore, compared with the metal hole arrays, the materials of the wall can include polypropylene and concrete, that expands the applications from the micro circuit electronic devices to macro walls, and greatly reduces the manufacturing cost.

DETAILED DESCRIPTION OF THE PREFERRED EMBODIMENTS

The invention will be further illustrated in more detail with reference to the accompanying drawings and embodiments. It is noted that, the following embodiments only are intended for purposes of illustration, but are not intended to limit the scope of the present invention.

Figure 1:
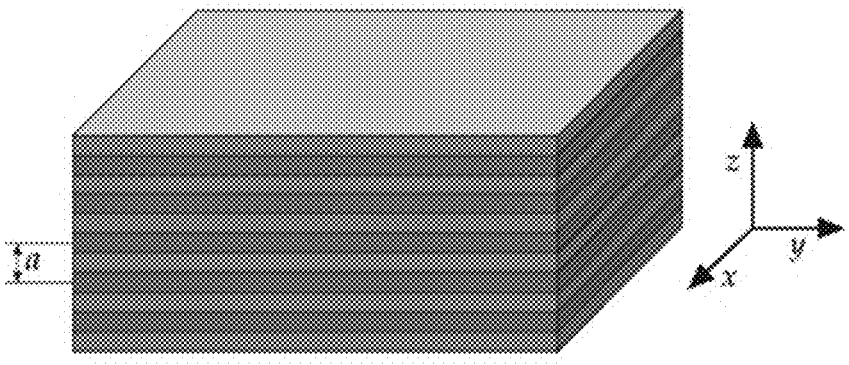
FIG. 1 is a schematic view of the device of present invention.

A device without blocking wireless signals based on impedance matching of a preferred embodiment of the present invention, is formed by periodically stacking polypropylene (dielectric constant $\varepsilon_1$=2.3) and concrete (dielectric constant $\varepsilon_2$=9) in the same direction in an alternate mode. As shown in FIG. 1, the polypropylene and the concrete are arranged as ABABABABA . . . , and are arranged periodically only in the z direction, wherein $d_{AB}$=a with a being the period length.

In order to study the impedance when electromagnetic waves enter the composite material of the present invention, a multi-physical field simulation software COMSOL Multiphysics software based on finite element method is used for theoretical simulation.

Figure 2:
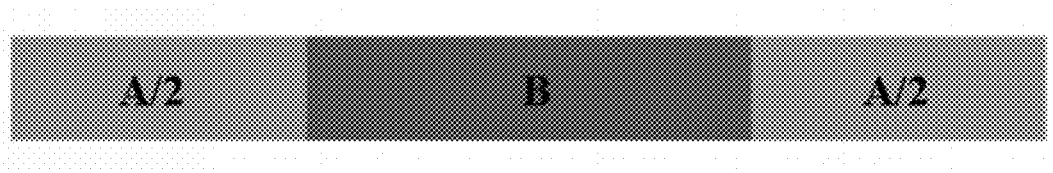
FIG. 2 shows a minimum period structure of the device of the present invention.

To simplify the operation, a minimal periodic repeating unit is selected for study, as shown in FIG. 2.

A broadband and wide-angle high transmission composite material indicates that its impedance is completely match with the impedance of the background medium. Because a symmetric structure is selected, and an electric (or magnetic) field is uniformly distributed at its boundary, on the basis of the definition of impedance in electrodynamics, the impedance of the composite material is calculated as followings:

$$Z_x^{PC}|_{x_{incident}} = \frac{\int_L E^{PC}\cdot\hat{z}dy}{\int_L H^{PC}\cdot\hat{y}dy},\ Z_y^{PC}|_{x_{incident}} = \frac{\int_L E^{PC}\cdot\hat{z}dy}{\int_L H^{PC}\cdot\hat{x}dy}. \quad (1)$$

Figure 3:
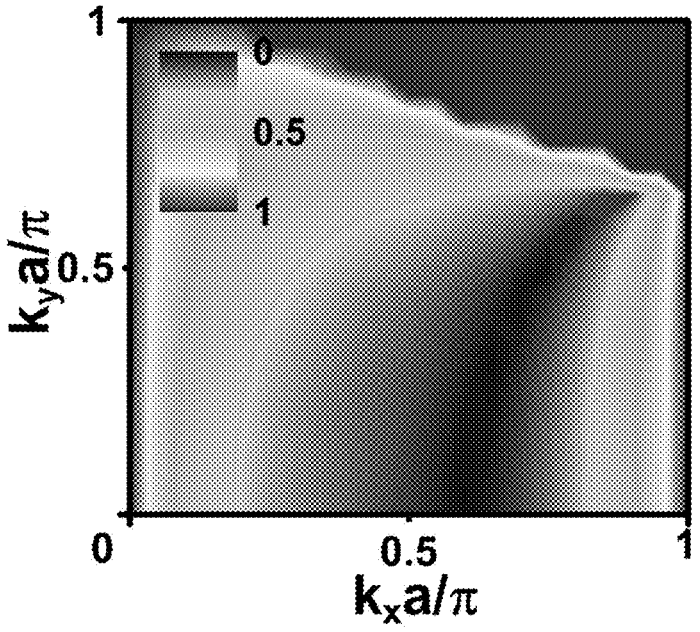
FIG. 3 shows the constant-impedance curve distribution of a minimum periodic structure in one fourth of a k space of the present invention.
Figure 4:
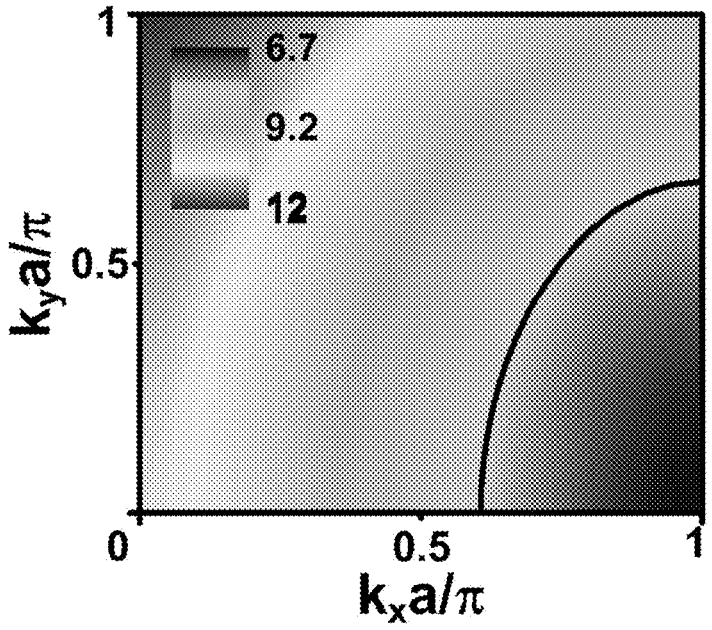
FIG. 4 is an equal frequency contour diagram corresponding to the constant-impedance curve distribution shown in FIG. 3.

Z represents the impedance. E and H represent the electric and magnetic fields, respectively. x represent an incidence direction, y represents a direction vertical to the incidence direction, and z represents a direction perpendicular to the xy plane. The PC represents a short name (Photonic crystals) of the material. Meanwhile, the air impedance can be obtained as:

$$Z_x = |Z_0| = \frac{\mu_0}{\sqrt{k_0^2 - k_y^2}}\omega, \quad (2)$$

where ω represents a circular frequency. $\mu_0$ represents a magnetic permeability in vacuum. FIG. 3 shows the constant-impedance curve distribution of the periodic structure in one fourth of the k-space. It can be seen that the deepest black region represents a place where the impedance of the composite material (i.e., photonic crystal) is equal to the impedance of air. The equal frequency contour of the photonic crystal is shown in FIG. 4, where the black solid line shows the frequency for exact impedance matching (f=8*c=2.4 GHz, c=3 $e^8$). The frequencies in a range from 0.25 to 0.75 on the horizontal axis in FIG. 4 can almost enable the impedance to basically match with the air impedance, thereby achieving the wide-angle broadband and unpolarized transmission of light waves in optical frequencies.

Figure 5:
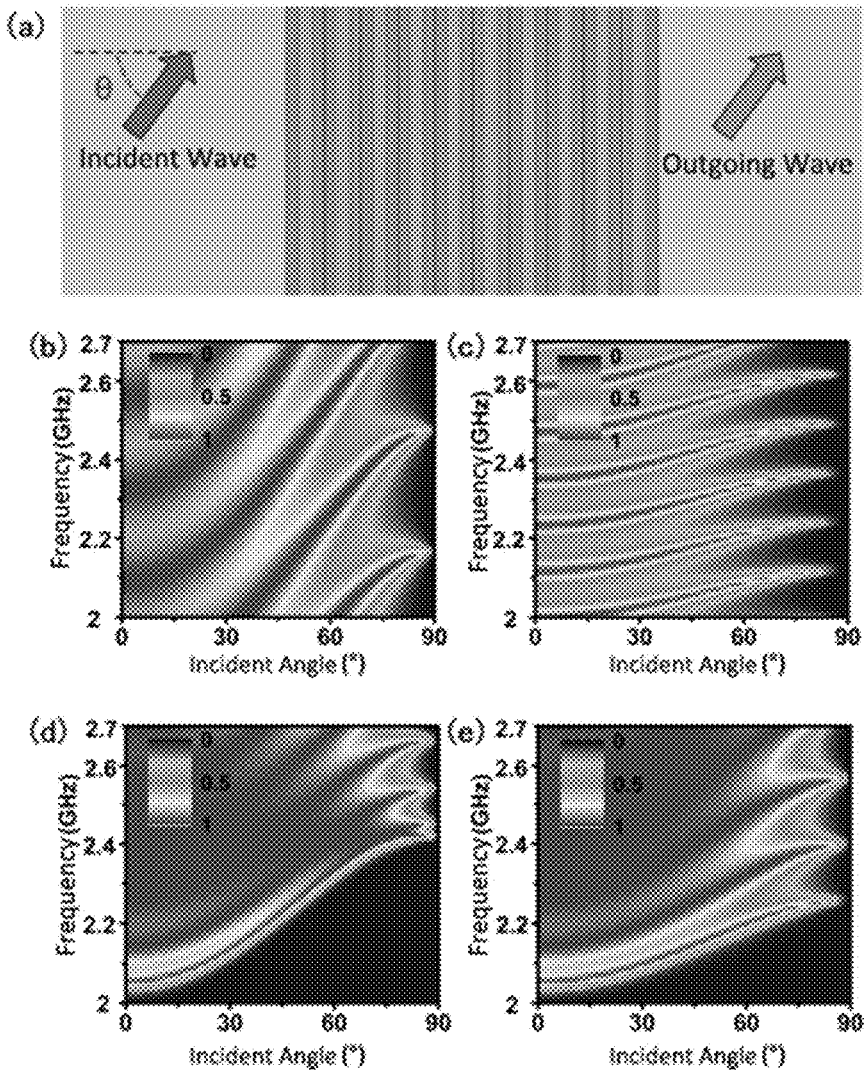
FIG. 5(*a*) is a structure simulation diagram, FIG. 5(*b*) represents full-angle transmission response and frequency response, wherein only $\varepsilon_1$ is included, FIG. 5(*c*) represents a transmission situation of angle and frequency response, wherein only $\varepsilon_2$ is included, and FIGS. 5(*d*) and (*e*) show the frequency- and angle-dependent transmission diagrams of a composite material for TE and TM polarization incidence, respectively.

Referring to the structure simulation diagram of FIG. 5(*a*), $\varepsilon_1$=2.3, $\varepsilon_2$=9, and the period a is 4.25 cm, wherein the dark grey represents the $\varepsilon_1$ portion, d1=0.6 a, the light grey represents the $\varepsilon_2$ portion, d2=0.4 a, and θ represents an incident angle. FIG. 5(*b*) represents the full-angle transmission response and frequency response, wherein only $\varepsilon_1$ is included (10-layer transmission). FIG. 5(*c*) represents a transmission situation of angle and frequency response, wherein only $\varepsilon_2$ is included (also 10-layer transmission). It can be seen that at 2 GHz to 2.7 GHz, the transmission in the presence of only one medium is not continuous, the angle of a high-permeability portion is also very narrow, but when the two media are arranged as the periodic structure (10-layer stacking) shown in FIG. 5(*a*), the inter-frequency discontinuous transmission can be partially eliminated, the range of the corresponding super-penetration angle becomes wider. As shown in FIGS. 5(*d*) and (*e*), nearby a Wi-Fi transmitting frequency of 2.4 GHz, both TE- and TM-polarized waves can achieve almost perfect transmission from 0 to 90 degree, thereby achieving "invisibility" for the Wi-Fi singles at this frequency. Furthermore, the composite material also has a relatively wide frequency response, and the 4G signal wavebands of China's three major communication operators can be basically covered.

Meanwhile, the materials for manufacturing the structure are also very common in daily life, mainly including polypropylene ($\varepsilon_1$=2.3) and concrete ($\varepsilon_2$=9) which are common building materials. The concrete, as a wall building material, has good durability, good plasticity and high strength. PP plastic (i.e., polypropylene) has low density, good formability, mechanical properties and bending fatigue resistance, and is non-toxic and anti-voltage, heat-resistant and corrosion-resistant, and has basic characteristics of wall materials. Also, the two materials are very cheap, and the process for manufacturing the structure is easy (the multilayer stacking depending on the specific thickness of the wall), and thus the construction cost can be greatly reduced.

The above description is only preferred embodiments of the present invention and not intended to limit the present invention, it should be noted that those of ordinary skill in the art can further make various modifications and variations without departing from the technical principles of the present invention, and these modifications and variations also should be considered to be within the scope of protection of the present invention.

What is claimed is:

1. A device without blocking wireless signals based on impedance matching, the device comprising periodically stacked two building materials with different dielectric constants in the same direction, wherein the two building materials are polypropylene having a dielectric constant of 2.3 and concrete having a dielectric constant of 9, and wherein the period length of the two building materials is 4.25 cm.

2. The device without blocking wireless signals based on impedance matching as claimed in claim 1, wherein the two building materials are periodically stacked in an alternate mode.

* * * * *